United States Patent [19]

Nyland

[11] 3,999,757

[45] Dec. 28, 1976

[54] GOLF CLUBS

[75] Inventor: Paul Nyland, Burnley, England

[73] Assignee: Norstrong Plastics Limited, Blackburn, England

[22] Filed: July 22, 1975

[21] Appl. No.: 598,002

[30] Foreign Application Priority Data

July 25, 1974 United Kingdom ..... 32828/74

[52] U.S. Cl. ..... 273/80.3; 273/80.5

[51] Int. Cl.[2] ..... A63B 53/02

[58] Field of Search ..... 273/80.1–80.8

[56] References Cited

UNITED STATES PATENTS

| | | | |
|---|---|---|---|
| 1,829,900 | 11/1931 | Johnson | 273/80.3 |
| 1,905,406 | 4/1933 | Barrett | 273/80.3 |
| 1,976,324 | 10/1934 | Buhrke et al. | 273/80.3 |
| 1,980,408 | 11/1934 | Jansky | 273/80.3 |
| 1,997,889 | 4/1935 | Smith | 273/80.3 |
| 2,198,350 | 4/1940 | Smith | 273/80.5 |
| 3,625,513 | 12/1971 | Ballmer | 273/80.5 |
| 3,759,527 | 9/1973 | Witherspoon | 273/80.2 X |
| 3,873,090 | 3/1975 | Thompson | 273/80.5 X |

FOREIGN PATENTS OR APPLICATIONS

| | | | |
|---|---|---|---|
| 256,050 | 8/1926 | United Kingdom | 273/80.3 |
| 404,152 | 1/1934 | United Kingdom | 273/80.5 |

*Primary Examiner*—Richard J. Apley

*Attorney, Agent, or Firm*—Brady, O'Boyle & Gates

[57] ABSTRACT

In order to provide for an adequate strength in the hosel region of a wooden golf club head which is adapted to receive a shaft through a bore therein, it is proposed to apply a conical ferrule to the end of the hosel and in intimate relationship therewith, the ferrule being secured in position axially of the said hosel. A plug having a flange and an elongated body portion is fitted on the shaft adjacent the ferrule. Cover means comprising either a generally conical sleeve or whipping is applied covering the ferrule and extending beyond the ends thereof as well as overlying the plug in the region of the body portion. Additionally a plurality of indicator rings are arranged on the outer surface of the plug's body portion between the flange and the termination of the cover means.

12 Claims, 5 Drawing Figures

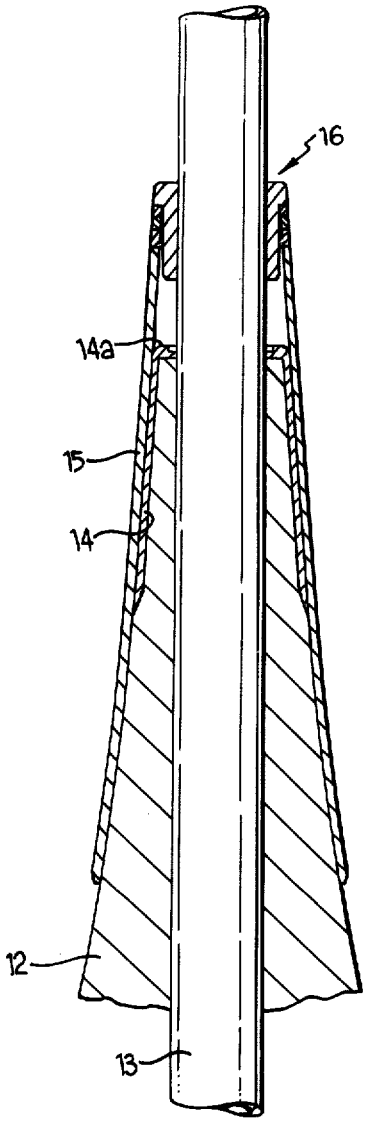
FIG. 3
FIG. 4
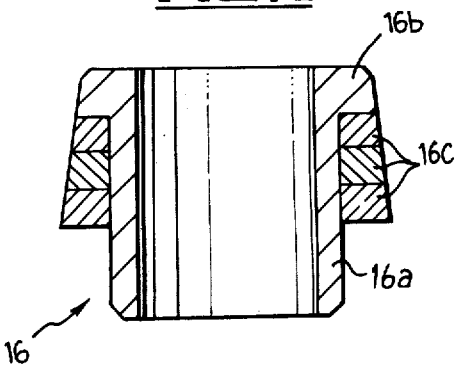

GOLF CLUBS

The invention concerns golf clubs and has more particular reference to the production of wooden clubs.

In securing a wooden club head to a shaft the conventional practice is to engage the lower end of the shaft with a hole drilled in the hosel and to secure the shaft in such hole by means of such as an adhesive.

By virture of its very form, that end of the hosel whereat the shaft extends from the club-head is of minimal wall thickness, especially at the remote end of the hosel, and, in view of the loads to which such part is subjected during use of the club, is liable to cracking, this being particularly so in the case of laminated club heads.

In order to avoid damage of this kind, it is usual to provide a whipping of a non-extensible thread about the hosel and club shaft for a limited axial extent thereof, and, in some cases, to apply a thin plastics sleeve, or sheath, to the whipping to improve the aesthetic effect of the club as a whole.

Whilst the whipping of the hosel and the adjacent part of the shaft is widely adopted, it is an unsatisfactory answer to the problem, for a variety of reasons. First, the application of the whipping is a time consuming, and hence expensive, operation, whilst the presence of such whipping detracts from the aesthetic effects of the club. Whilst the application of a sleeve-like cover to the whipping goes some way towards offsetting the damaging effect of the whipping on the aesthetic character of the club, that the sleeve exhibits the surface contours of the whipping prevents complete compensation.

The primary object of the invention is to provide an alternative to the whipping as a means of strengthening the hosel at the remote end thereof.

According to the present invention it is proposed that a ferrule be applied to the end of the hosel in closely fitting relationship with the outer periphery thereof, the ferrule being adequate fully to sustain the integrity of the said hosel end against bursting pressure met with in normal usage of the club.

According to a preferred feature, a generally conical sleeve will be provided in coaxial relationship with the hosel and shaft, such sleeve overlying the aforesaid ferrule and extending axially beyond the ferrule at each end thereof.

The invention will now be described further, by way of example only, with reference to the accompanying drawings in which:

FIG. 3 is a view corresponding to FIG. 2 of the preferred embodiment of the invention;

FIG. 4 shows a part of FIG. 3 drawn to a larger scale; and

Figure 2:
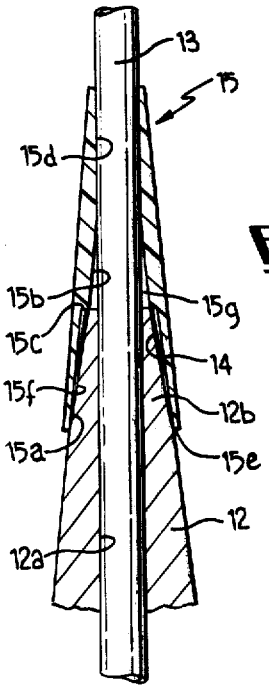
FIG. 2 is a longitudinal section taken through the upper part of the hosel and adjacent shaft part of the club shown in FIG. 1.
Figure 1:
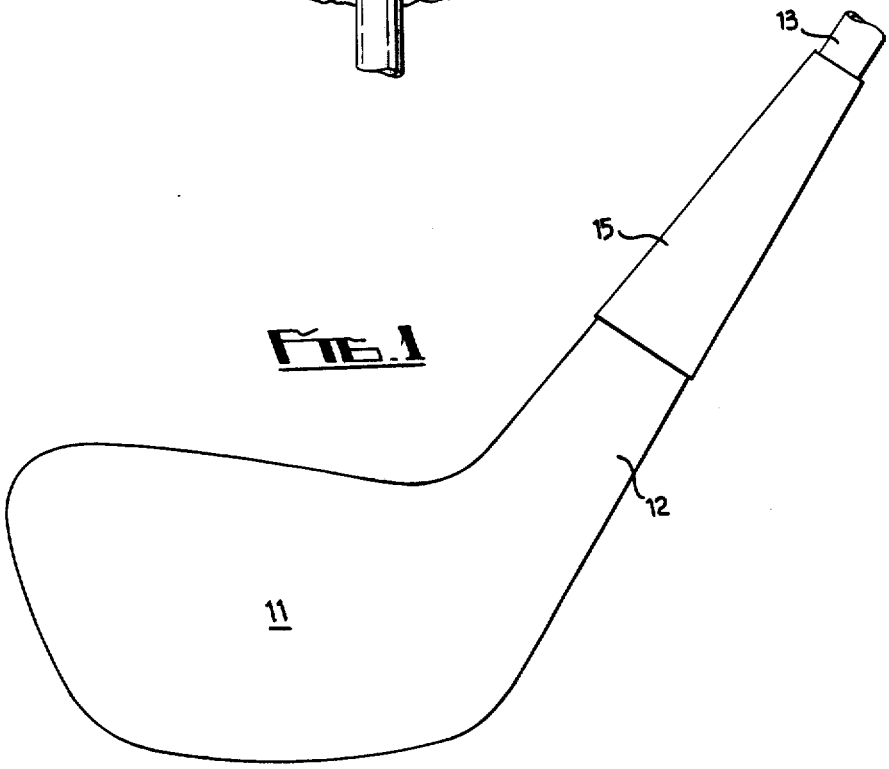
FIG. 1 is a diagrammatic front elevation of a wooden golf club embodying the invention.

Referring now to the drawings, and particularly to FIGS. 1 and 2 thereof, a wooden club head 11 having a hosel 12 is mounted on a shaft 13, the shaft being engaged with the hosel bore 12*a* (FIG. 2) in conventional manner.

In accordance with the configuration shown by FIGS. 1 and 2 the hosel is of slightly shorter form than is usually the case, and the extremity 12*b* of such hosel is trimmed to a greater cone angle, of, say, 18° than the adjacent part of the hosel.

A stainless steel ferrule 14 of a conical form complementary to the extremity of the hosel as trimmed is applied as a press-fit thereto, the ferrule being of such wall thickness and axial extent as is adequate to maintain the integrity of the end of the hosel against the loads applied thereto during normal usage of the club.

Cover means comprising conical sleeve 15 of a synthetic plastics material is provided outwardly of ferrule 14, the sleeve 15 being of such length as to extend beyond the extremities of the stainless steel ferrule 14 at each end thereof, as is apparent from the drawing. The sleeve 15 has a stepped conical bore thereto, the larger diameter end having a bore 15*a* of a slightly lesser cone angle, say an angle of somewhat less than 18°, than the end of the hosel 12, such bore being separated from an intermediate section 15*b* of relative small cone angle, say 6°, by a shoulder 15*c*. The smaller diameter end of the sleeve 15 has a cylindrical bore 15*d* of such diameter as to be a press-fit on the shaft 13. When in position on the club, the shoulder 15*c* of the sleeve bore bears against the end of the hosel and of the sleeve 15 provided thereat, the extremity 15*e* of the sleeve contacting the surface of the hosel and there being an annular space 15*f* between the surface of the hosel 12 and the adjacent ferrule 14, on the one hand, and the inner surface of the sleeve 15, on the other hand. Similarly, there is an annular space 15*g* between the intermediate section 15*b* and the surface of the shaft.

Adhesive is provided both in annular space 15*f* and annular space 15*g* to secure the sleeve in position on the club, the ferrule 14 thereby being located axially relative to the hosel.

By means of the present invention now to be described, the need to whip the hosel/shaft area thus to prevent splitting of the hosel is avoided and, furthermore, an aesthetically pleasing joint is effected.

Referring now to FIGS. 3 and 4 in which like reference numerals to those of FIGS. 1 and 2 are used for the same or similar parts, the sleeve 15 is of generally conical form and of constant wall thickness, with the stainless steel ferrule 14 and sleeve 15 being of a like cone angle over corresponding axial parts thereof, such angle corresponding generally to that of the adjacent part of the hosel 12, the neck of the hosel at such adjacent part being of slightly lesser cone angle that the lower part of the hosel, as is apparent from the drawing. In contradistinction to the embodiment of FIGS. 1 and 2, the hosel is of conventional length, whilst, at either end of the truly conical part of the sleeve, such sleeve is of slightly flared form, as can be seen in the drawing.

The lesser diameter end of the ferrule is formed with a radially inwardly directed lip 14*a*, whilst the lesser diameter end of the sleeve is clearance on the shaft to receive a closure plug 16 into engagement therewith.

The closure plug 16 is shown to a larger scale in FIG. 4 and will be seen to comprise a sleeve-like body 16*a* having a radially outwardly extending lip 16*b* at one end and a plurality of indicator rings 16*c* arranged coaxially with the body and in abutment with the lip, the rings being a press-fit onto the body and the colour combination thereof being appropriate to the indication desired or, alternatively, being determined from aesthetic considerations.

In assembling the structure, the stainless steel ferrule 14 is applied to the hosel 12, and the conical sleeve 15 disposed coaxially thereabout, progressive engagement of such sleeve 15 with the hosel 12 drawing the ferrule 14 downwardly onto the hosel with the lip 14*a* thereto in engagement with the annular end face of the hosel. The assembly is completed by the engagement of the closure plug 16 with the upper end of the sleeve 15, the lowermost ring (as seen in FIG. 4) abutting the top of the sleeve, and the conical form of the outer surface of the plug matching that of such sleeve. If desired the upper end of the sleeve may be counter bored or otherwise formed to define a cylindrical seating to receive the closure plug. It is to be understood, of course, that appropriate adhesive materials will be provided between the relevant ones of the abutting surfaces to effect a secure attachment together of the various parts.

As will be apparent from the drawing, the outward flaring of the sleeve at its lower end, allied to the increase in the cone angle of the relevant part of the hosel, permits of the avoidance of any bulge in the sleeve in the region of the ferrule, and facilitates the attainment of a pleasing aesthetic effect in the total structure.

The invention is not restricted to the exact features of the embodiment disclosed in FIGS. 3 and 4, since alternatives will readily present themselves to one skilled in the art. Thus, whilst the cover means in the form of a sleeve would ordinarily be provided, and thus the ferrule and hosel end would be masked in some cases it might be preferred that the cover means comprise a whipping, as shown in FIG. 5.

Figure 5:
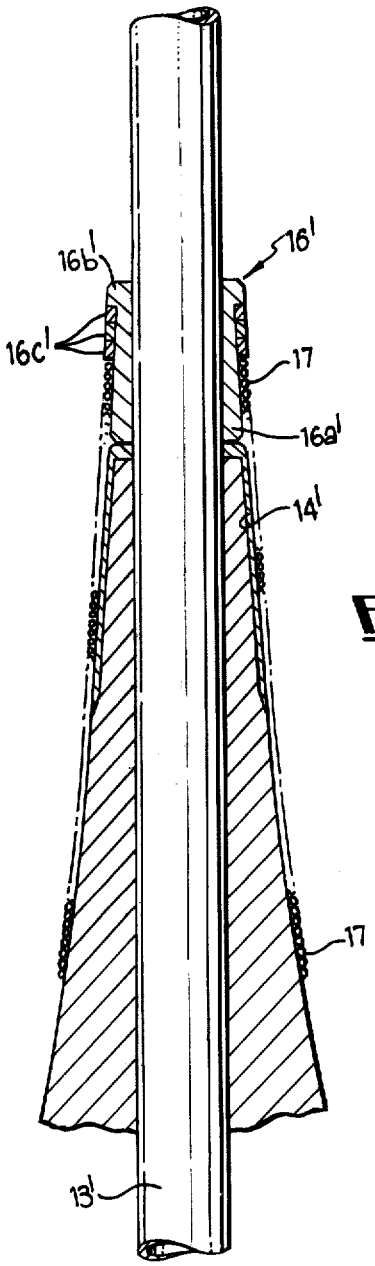
FIG. 5 is a view corresponding to FIG. 3 and showing an alternative arrangement to that shown in FIG. 3.

In this latter event a slightly different closure plug 16' is utilised, see now FIG. 5, and is arranged in axially aligned abutment with the stainless sleeve ferrule 14', being secured in position relative to such ferrule 14' and to the club shaft 13' by frictional forces in that the closure plug 16' is a press-fit on the shaft 13'. The aesthetic effect will also be improved by means of the whipping 17. The modified plug envisaged for use in this way differs from that shown in FIG. 4 in that the shank portion 16'*a* below the indicator rings 16'*c* is of conical form, being of a like cone angle to the ferrule and being of a maximum diameter corresponding to that of the smaller end of the ferrule.

I claim:

1. A wooden golf club comprising in combination:

a clubhead, a hosel including a bore for receiving a shaft extending from and integral with said clubhead, a shaft fitted into said bore, a ferrule applied to the end of said hosel in close fitting relationship with the outer periphery thereof, said ferrule being adequate to fully sustain the integrity of the end of said hosel against bursting pressures met with the normal usage of the club, a plug member on the shaft adjacent said ferrule, and generally conical cover means coaxially located with said hosel, shaft, and ferrule, said cover means extending beyond the axial limits of said ferrule at each end thereof and partially overlying said adjacent plug member.

2. The club as defined by claim 1, wherein said cover means comprises a sleeve.

3. The club as defined by claim 1, wherein said cover means comprises whipping.

4. The club as defined by claim 1, wherein the ferrule is comprised of stainless steel.

5. The club as defined by claim 1, wherein the ferrule has one end which has a smaller diameter than the other end, and wherein the smaller diameter end has an inwardly turned lip.

6. The club as defined in claim 1, wherein said cover means and ferrule are of like conicity.

7. The club as defined by claim 1, wherein said cover means is comprised of means having substantially constant thickness throughout substantially the whole axial extent thereof.

8. The club as defined by claim 2, wherein the sleeve has a relatively smaller diameter end which exists in spaced relation to the shaft to define a generally annular space adapted to receive the plug member.

9. The club as defined by claim 1, wherein the plug member is abutted against the ferrule, said plug member having a shank portion of conical form substantially like that of the ferrule, said shank portion having an end diameter substantially corresponding to the smaller end diameter of the ferrule.

10. The club as defined in claim 1, and additionally including a plurality of indicator rings coaxially arranged on the outer surface of said plug member adjacent said cover means.

11. The club as defined by claim 10, wherein said plug member includes a radially extending flange at one end thereof against which said indicator rings abut.

12. The club as defined by claim 11, wherein the plug member includes a radially outwardly extending flange at one end thereof and a generally conical body portion having an outer surface to engage said cover means.

* * * * *